US005252249A

United States Patent [19]

Kurachi et al.

[11] Patent Number: 5,252,249

[45] Date of Patent: Oct. 12, 1993

[54] POWDER AND ELECTRORHEOLOGICAL FLUID

[75] Inventors: Yasuo Kurachi, Tokyo; Tasuku Saito, Tokorozawa; Yoshiki Fukuyama, Kodaira; Shigeki Endo, Tokorozawa, all of Japan

[73] Assignee: Bridgestone Corporation, Tokyo, Japan

[21] Appl. No.: 682,946

[22] Filed: Apr. 10, 1991

[30] Foreign Application Priority Data

| | | | |
|---|---|---|---|
| Apr. 26, 1990 | [JP] | Japan | 2-111467 |
| May 14, 1990 | [JP] | Japan | 2-123870 |
| May 14, 1990 | [JP] | Japan | 2-123871 |

[51] Int. Cl.[5] ..... C10M 169/00; C10M 169/04

[52] U.S. Cl. ..... 252/71; 252/73; 252/74; 252/75; 252/510; 252/572

[58] Field of Search ..... 252/73, 74, 75, 71, 252/572, 510, 518, 508, 511, 506, 516

[56] References Cited

U.S. PATENT DOCUMENTS

| | | | |
|---|---|---|---|
| 3,923,697 | 12/1975 | Ellis | 252/510 |
| 4,110,260 | 8/1978 | Yamamoto et al. | 252/508 |
| 4,224,068 | 9/1980 | Harvey | 252/512 |
| 4,282,117 | 8/1981 | Muramoto et al. | 252/508 |
| 4,786,438 | 11/1988 | Blackmore | 252/512 |
| 4,795,735 | 1/1989 | Liu et al. | 502/415 |
| 4,816,184 | 3/1989 | Fukuda et al. | 252/511 |
| 4,865,772 | 9/1989 | Suehiro et al. | 252/512 |
| 4,958,998 | 9/1990 | Yamauchi et al. | 252/508 |

FOREIGN PATENT DOCUMENTS

| | | |
|---|---|---|
| 60-31211 | 6/1977 | Japan . |
| 53-93186 | 8/1978 | Japan . |
| 61-216202 | 9/1986 | Japan . |
| 62-95397 | 5/1987 | Japan . |
| 63-97694 | 4/1988 | Japan . |
| 1-164823 | 6/1989 | Japan . |
| 1-180240 | 7/1989 | Japan . |
| 2-169695 | 6/1990 | Japan . |
| 2170510 | 8/1986 | United Kingdom . |

OTHER PUBLICATIONS

Translation of Japanese Patent 1-180240, published Jul. 18, 1989.

*Primary Examiner*—Christine Skane

*Attorney, Agent, or Firm*—Birch, Stewart, Kolasch & Birch

[57] ABSTRACT

A powder having improved oxidation resistance and controlled electrical properties is obtained by dispersing minute particulates in a matrix phase to form composite particles. The minute particulates may be distributed uniformly or non-uniformly such that the particulates are dense near the surface and sparse near the center of each particle or inversely. The matrix phase has a moderate conductivity of $10^{-10}$ to $10^{2}$ $Scm^{-1}$, and the dispersed particulates have a low conductivity of up to 1/10 of that of the matrix phase, typically up to $10^{-2}$ $Scm^{-1}$. Alternatively, the matrix phase has a lower conductivity and the dispersed particulates have a moderate conductivity. The powder is dispersed in an insulating oily medium to form an electrorheological fluid.

15 Claims, 2 Drawing Sheets

POWDER AND ELECTRORHEOLOGICAL FLUID

This invention relates to a functional powder having minute particulates dispersed in a matrix phase and an electrorheological fluid having such powder dispersed in an oily medium having an electrical insulating property.

BACKGROUND OF THE INVENTION

An electrorheological fluid is a fluid whose viscoelasticity can be widely changed in a reversible manner by electrical control. Well known for the electrorheological fluid is the Winslow Effect; namely that certain fluids manifest an increase in apparent viscosity upon application of an electrical potential thereto. The old day electrorheological fluids which were typically composed of starch dispersed in mineral oil or lubricating oil were satisfactory for recognizing the importance of electrorheological effect, but lacked reproducibility.

In order to provide fluids having improved electrorheological effect and reproducibility, a number of proposals have been made with the main focus being on the powder used as the dispersed phase. There are known a variety of powders, for example, a highly water-absorbing resin having an acid group such as polyacrylic acid (Japanese Patent Application Kokai No. 93186/1978), an ion exchange resin (Japanese Patent Publication Kokai No. 31211/1985), and alumina silicate (Japanese Patent Application Kokai No. 95397/1987). All these electrorheological fluids are composed of a hydrophilic solid powder having water absorbed therein and being dispersed in an insulating oily medium. When a high electrical potential is externally applied to the fluid, the water helps the powder particles to polarize so that bridging occurs between the particles in a potential direction, resulting in a viscosity increase.

The hydrous electrorheological fluids based on such hydrous powder, however, suffered from many problems in practical applications. The problems included insufficient electrorheological effect over a wide temperature range, a limited service temperature range for avoiding evaporation and freezing of water, a marked current increase associated with a temperature rise, lack of stability due to water migration, and dissolution and corrosion of metal electrodes associated with a high electrical potential applied. It was thus quite difficult to use these hydrous electrorheological fluids in commercial applications.

In order to overcome the drawbacks of the hydrous electrorheological fluids, it was proposed to use powder of water-free particles in order to provide non-aqueous electrorheological fluids. A number of such non-aqueous fluids are known. For example, a fluid using a powder of uniform monophase particles, that is, particles of a uniform phase composed solely of an organic compound having electrical (or semiconductive) properties, such as organic semiconductor particles of poly(acenequinone) or the like (see Japanese Patent Application Kokai No. 216202/1986 or GB 2 170 510 A published Aug. 6, 1986). Additionally, a fluid using a powder of thin film-coated composite particles, is known. The particles are covered with thin film layers having electrical (conductive/insulating) properties, so as to form dielectric particles in which organic or inorganic solid particles are coated on the surface with an electroconductive thin film layer and thereon with an electrically insulating thin film layer (see Japanese Patent Application Kokai Nos. 97694/1988 and 164823/1989).

Nevertheless, the non-aqueous electrorheological fluids, regardless of whether uniform monophase particles or thin film-coated composite particles are employed, have not been used in commercial applications because of the lack of long-term stability of their properties, poor reproducibility, an increased power consumption upon application of an electrical potential due to increased quantity of electric current flows across the fluid, and difficulty of industrial manufacture.

Therefore, there is a need for a powder suitable as the dispersed phase of a non-aqueous electrorheological fluid.

It is to be noted that in addition to the uniform monophase particles and thin film-coated composite particles mentioned above, several powders are known which have controlled electrical properties, such as, a carbon powder fired at different temperatures, a surface treated metal powder, and a metal coated inorganic powder. Since these powders were used mainly for their electrical properties, they had many problems including poor resistance against heat and oxidation and difficult control of electrical resistance and dielectric constant and thus were found to be of only limited application. Therefore, it is also desired to develop a powder having improved functions.

SUMMARY OF THE INVENTION

An object of the present invention is to provide a highly functional powder having oxidation resistance and controlled electrical properties and suitable for use as the dispersed phase of electrorheological fluid. Another object is to provide a novel electrorheological fluid which has overcome the above-mentioned drawbacks of the prior art fluids.

Paying attention to the structure and electrical properties of particles, the inventors have found that a powder of individual composite particles having minute particulates dispersed in a matrix phase has improved heat resistance, oxidation resistance and other properties and is a quite useful dispersed phase for an electrorheological fluid.

More particularly, we have found that there is obtained a highly functional powder having improved heat resistance, oxidation resistance and ease of control of electrical resistance and dielectric constant when minute particulate non-uniformly dispersed composite particles are prepared, for example, by impregnating organic particles having a high carbon retention with a metal compound and carbonizing the particles such that minute particulates having a lower electrical conductivity are non-uniformly dispersed and distributed more on the surface side and less on the central side in the matrix phase. Alternatively, the minute particulates having a lower electrical conductivity can be non-uniformly dispersed and distributed less on the surface side and more on the central side in the matrix phase. When the matrix phase has an electrical conductivity of $10^{-10}$ to $10^{2}$ $Scm^{-1}$, the dispersed particulates have an electrical conductivity of up to 1/10 of that of the matrix phase. Preferably, the dispersed particulates are present in an amount of up to 40% by weight based on the weight of each composite particle.

Also, we have found that there is obtained a highly functional powder having improved heat resistance, oxidation resistance and ease of control of electrical resistance and dielectric constant when minute particulate uniformly dispersed composite particles are prepared, for example, by mixing an organic compound with a metal compound, granulating the mixture, and carbonizing the particles such that minute particulates having a lower electrical conductivity are uniformly dispersed and distributed in a matrix phase, and when the matrix phase have an electrical conductivity of $10^{-10}$ to $10^{2}$ $Scm^{-1}$, the dispersed particulates have an electrical conductivity of up to 1/10 of that of the matrix phase. Preferably, the dispersed particulates are present in an amount of up to 70% by weight based on the weight of each composite particle.

We have further found that as opposed to the composite particles in which the matrix phase has a higher electrical conductivity than the minute particulates, the same objects can be attained by composite particles in which the minute particulates have a higher electrical conductivity than the matrix phase. More particularly, we have found that there is obtained a highly functional powder having improved heat resistance, oxidation resistance and ease of control of electrical resistance and dielectric constant when minute particulate dispersed composite particles are prepared, for example, by mixing an organic compound having a high carbon retention with a metal compound, granulating the mixture and carbonizing the particles such that minute particulates having a higher electrical conductivity are dispersed and distributed in a matrix phase, and the dispersed particulates have an electrical conductivity of $10^{-10}$ to $10^{2}$ $Scm^{-1}$ and at least 10 times that of the matrix phase. Preferably, the dispersed particulates are present in an amount of 15 to 99.5% by weight based on the weight of each composite particle.

Moreover, we have found that an electrorheological fluid having a high function essentially distinguishable from the conventional fluids using uniform monophase particles and thin film-coated composite particles described in the preamble, that is, an electrorheological fluid capable of providing an enhanced electrorheological effect over a wide temperature range, maintaining the effect stable over a long term, and allowing passage of a reduced quantity of current with an electrical potential applied thereto is obtained by using the above-mentioned powder comprising minute particulate non-uniformly dispersed composite particles of the novel structure in which a minute particulate dispersed phase having a lower electrical conductivity is non-uniformly dispersed in a matrix phase having a moderate electrical conductivity; the powder comprising minute particulate uniformly dispersed composite particles of the novel structure in which a minute particulate dispersed phase having a lower electrical conductivity is uniformly dispersed in a matrix phase having a moderate electrical conductivity; or the powder comprising minute particulate dispersed composite particles of the novel structure in which a minute particulate dispersed phase having a moderate electrical conductivity is dispersed in a matrix phase having a lower electrical conductivity.

The present invention is predicated on these findings.

Accordingly, in a first aspect, the present invention provides a powder comprising composite particles each having minute particulates uniformly dispersed in a matrix phase. The matrix phase has an electrical conductivity of $10^{-10}$ to $10^{2}$ $Scm^{-1}$. The dispersed particulates have an electrical conductivity of up to 1/10 of that of the matrix phase, preferably up to $10^{-2}$ $Scm^{-1}$. Preferably, the dispersed particulates are present in an amount of up to 70% by weight based on the weight of each composite particle.

In a second aspect, the present invention provides a powder comprising composite particles each having minute particulates non-uniformly dispersed in a matrix phase such that more minute particulates are present on a surface side and less minute particulates are present on a central side. An inverse distribution is also acceptable, that is, less minute particulates are present on the surface side and more minute particulates are present on the central side. In either distribution, the matrix phase has an electrical conductivity of $10^{-10}$ to $10^{2}$ $Scm^{-1}$. The dispersed particulates have an electrical conductivity of up to 1/10 of that of the matrix phase, preferably up to $10^{-2}$ $Scm^{-1}$. The dispersed particulates are present in an amount of up to 40% by weight based on the weight of each composite particle.

In a third aspect, the present invention provides a powder comprising composite particles each having minute particulates dispersed in a matrix phase. The dispersed particulates have an electrical conductivity of $10^{-9}$ to $10^{2}$ $Scm^{-1}$ and at least 10 times that of the matrix phase. The matrix phase preferably has an electrical conductivity of up to $10^{-2}$ $Scm^{-1}$. Also preferably, the dispersed particulates are present in an amount of 15 to 99.5% by weight based on the weight of each composite particle.

Also contemplated is an electrorheological fluid having a powder as set forth above dispersed in an oily medium having electrical insulating property.

BRIEF DESCRIPTION OF THE DRAWINGS

The above and other objects, features, and advantages of the present invention will be better understood from the following description taken in conjunction with the accompanying drawings, in which.

DESCRIPTION OF THE PREFERRED EMBODIMENTS

First Form of Powder

In a first form of the invention, the powder is comprised of composite particles in each of which minute particulates having a low electrical conductivity are dispersed in a matrix phase having a moderate electrical conductivity. The distribution of minute particulates in the matrix phase may be either uniform or non-uniform.

Reference is first made to a powder comprising composite particles of the non-uniform dispersion type in which a minute particulate dispersed phase having a low conductivity is non-uniformly dispersed in a matrix phase having a moderate conductivity such that the minute particulates are present more on a surface side and less on a central side or inversely, the minute particulates are present less on the surface side and more on the central side.

Figure 1:
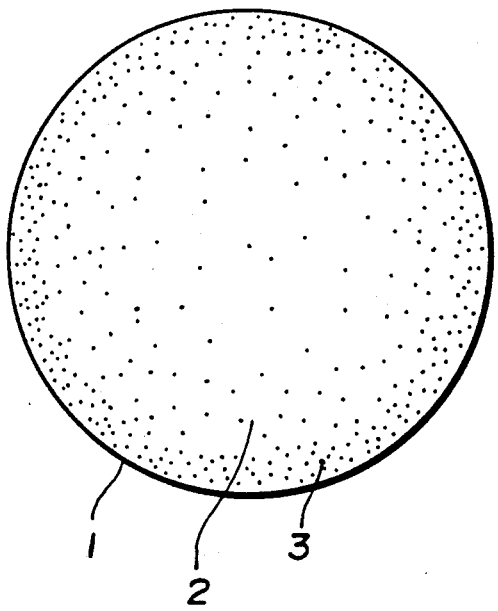
FIG. 1 is a schematic cross sectional view of a composite particle of the minute particulates non-uniformly dispersed type according to one embodiment of the invention.
Figure 2:
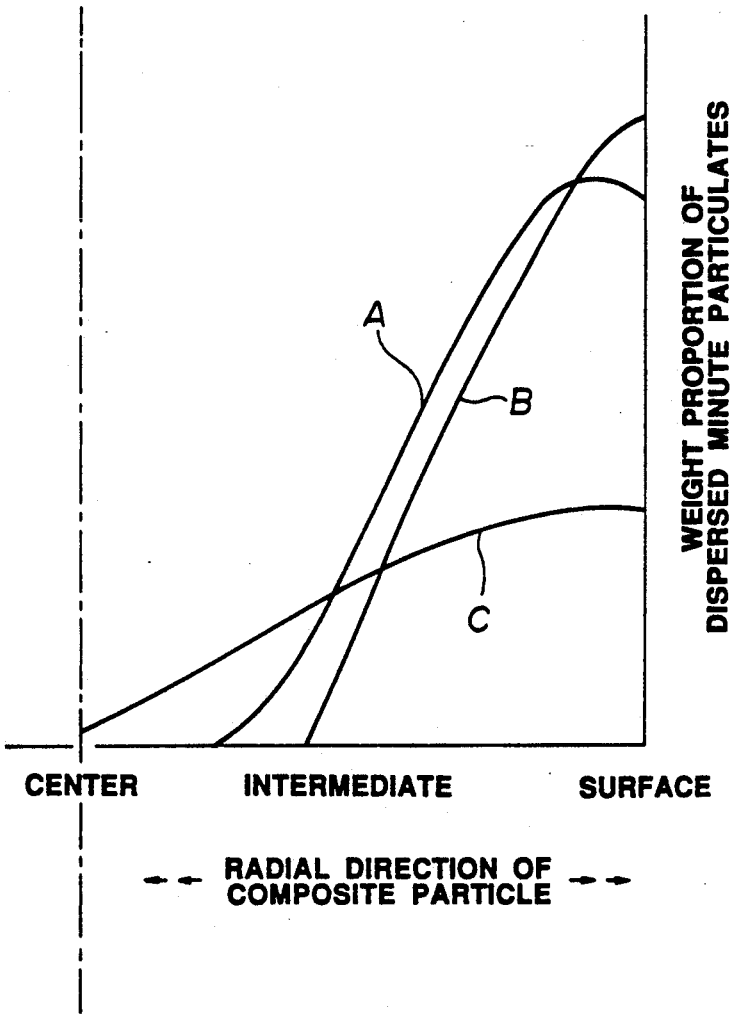
FIG. 2 is a diagram showing the distribution (in weight proportion) of minute particulates in successive regions from the surface to the center of the composite particle of FIG. 1.

Referring to FIG. 1, a particle 1 is illustrated as assuming a spherical shape having a center and an outer surface although the actual particle shape need not be limited thereto. The particle 1 has a microscopic composite structure or sea-island structure in which minute particulates 3 having a low conductivity are non-uniformly dispersed in a matrix phase 2 having a moderate conductivity such that the minute particulates are present more or dense near the surface and present less or sparse near the center of the particle. The non-uniform distribution of minute particulates is readily understood from curves A, B and C of FIG. 2 in which the population or density (in weight proportion) of minute particulates is plotted along a radial line from the center to the surface of the particle. The composite particle has a negatively graded concentration of dispersed minute particulates in a radially inward direction from the surface to the center such that the weight proportion of dispersed minute particulates is higher in a surface adjoining layer and gradually decreases toward the center of the particle through intermediate layers as seen from FIG. 2. This means that the composite particle has a positive gradient of conductivity in a radially inward direction from the surface to the center because the conductivity is low near the surface and gradually increases toward the center of the particle.

Alternatively, the powder of the invention may be comprised of composite particles of the inverse structure to the structure of FIG. 1, that is, a microscopic composite structure or sea-island structure in which minute particulates having a low conductivity are non-uniformly dispersed in a matrix phase having a moderate conductivity such that the minute particulates are present less or sparse near the surface and present more or dense near the center of the particle.

In either of the graded structures, the matrix phase has a moderate conductivity in the range of from $10^{-10}$ to $10^{2}$ $Scm^{-1}$, preferably from $10^{-10}$ to $10^{0}$ $Scm^{-1}$. The material of which the matrix phase is formed may be either organic or inorganic insofar as it has a conductivity within the specific range. Examples of the matrix-forming material include carbonaceous materials, carbides such as boron carbide and aluminum carbide, organic semiconductor materials such as polyaniline and poly(acene-quinone), and oxide type semiconductor materials such as zinc oxide, potassium titanate, and barium titanate. Preferred are carbonaceous materials often having a carbon content of 80 to 99.9% by weight, especially 90 to 99% by weight, the balance being usually hydrogen, oxygen and nitrogen atoms.

Dispersed in the matrix phase are minute particulates which should have a lower conductivity than the matrix phase in the first form. Namely, the conductivity of the dispersed phase is up to 1/10 of that of the matrix phase, preferably from 1/10 to $1/10^{14}$, especially from $1/10^{3}$ to $1/10^{14}$ of that of the matrix phase. At the same time as meeting this requirement, the minute particulates or dispersed phase should preferably have a low conductivity of up to $10^{2}$ $Scm^{-1}$, more preferably up to $10^{-6}$ $Scm^{-1}$.

The minute particulates may be formed of any desired materials having a conductivity within the specific range. The minute particulate-forming material is generally selected from insulating and semiconductor materials, for example, oxides such as alumina, silica, boron oxide, titania, calcium oxide, iron oxide, tin oxide, and zinc oxide, and non-oxides such as silicon carbide, silicon nitride, and aluminum nitride. Preferred are silica, alumina and titania.

Preferably, the minute particulates have a size of from about 1 nm to about 1 μm, more preferably from about 2 nm to about 0.5 μm. The total amount of minute particulates dispersed ranges from 0.01 to 40% by weight, preferably from 0.1 to 30% by weight based on the weight of each composite particle. Less than 0.01% would be ineffective for the purpose of the invention whereas more than 40% can sometimes interfere with the preparation of composite particles. When the composite particles are graded such that the minute particulates are dispersed more on the surface side and less on the center side, preferably the quantity of minute particulates dispersed is 0.1 to 99%, especially 1 to 95% by weight on the surface side, and 0 to 30%, especially 0 to 25% by weight near the center side provided that the dispersed quantity on the surface side is at least 1.5 times, especially at least 3 times that on the center side. These dispersed quantities may be interchanged when it is desired that the composite particles are graded such that the minute particulates are dispersed less on the surface side and more on the center side.

As to the composite particles 1 composed of the matrix phase 2 and the minute particulates 3 dispersed therein, the mean particle size is not particularly limited. When the composite particles are used as the dispersed phase of an electrorheological fluid which is described later in detail, they preferably have a mean particle size of 0.1 to 100 μm, especially 0.5 to 50 μm. A fluid loaded with particles of less than 0.1 μm in size has an extremely high initial viscosity when no electrical potential is applied and thus exhibits a less change in viscosity due to the electrorheological effect whereas particles having a size of more than 100 μm remain less stable in a fluid.

The powder composed of the above-defined composite particles is not particularly limited in conductivity although it preferably has an conductivity of $10^{-13}$ to $10^{2}$ $Scm^{-1}$, more preferably $10^{-12}$ to $10^{2}$ $Scm^{-1}$ as measured on a compact molded from the powder.

The powder should preferably have a water content of up to 1% by weight, more preferably up to 0.5% by weight. Retention of more than 1% by weight of water can lead to an increase in power consumption at elevated temperatures due to the conduction by water.

Parameters indicative of the internal structure of the composite particles according to the invention, that is, morphology and physical parameters may be readily determined by various well-known analysis techniques as demonstrated in Examples later.

The composite particles of the non-uniform dispersion type in which minute particulates having a lower conductivity are distributed more on a surface side and less on a center side in a matrix phase may be prepared by any desired methods, for example, methods (A) to (D) as given below.

(A) Composite particles are prepared by starting with organic particles of a thermoplastic resin such as phenol resin, furan resin, polydimethylsilane resin, melamine resin, and epoxy resin, which has been treated with radiation or rendered infusible, impregnating the organic particles with a compound, for example, a metal alkoxide (e.g., ethyl silicate, aluminum isopropoxide, and titanium isopropoxide), an organometallic complex (e.g., ferrocene), and an ester of an organic compound with an inorganic acid (e.g., a borate ester synthesized from diethanol amine and boric acid), and heat treating the impregnated particles for carbonization.

(B) Composite particles are prepared by starting with organic particles having a high carbon retention, for example, of a phenol resin, furan resin or polydimethyl silane resin, applying a compound such as a metal alkoxide, an organometallic complex, and an ester of an organic compound and an inorganic acid to the surface of the organic particles, further coating the particles with a liquid organic compound having a high carbon retention, and heat treating the coated particles for carbonization.

(C) Composite particles are prepared by starting with organic particles having a high carbon retention, for example, of a phenol resin, furan resin or polydimethyl silane resin, applying a mixture of a compound such as a metal alkoxide, an organometallic complex, and an ester of an organic compound and an inorganic acid and a liquid organic compound having a high carbon retention to the surface of the organic particles, and heat treating the coated particles for carbonization.

(D) Composite particles are prepared by heat treating organic particles having a high carbon retention, for example, of a phenol resin, furan resin or polydimethyl. silane resin, applying a compound capable of forming minute particulates having a desired conductivity to the surface of the particles by such a technique as chemical vapor deposition (CVD), and heat treating the coated particles for carbonization.

The composite particles of the non-uniform dispersion type in which minute particulates having a lower conductivity are distributed less on a surface side and more on a center side in a matrix phase may be prepared by method (E) given below.

(E) Composite particles are prepared by furnishing cores of a compound which has a low solubility in water at low temperatures, but a high solubility at elevated temperatures and is capable of forming an oxide at elevated temperatures, and coating the cores with a phenolic resin. The resin coated cores are impregnated with water as by dipping in hot water and thereafter, carbonized.

More particularly, a resol type phenolic resin is granulated and cured in water containing boric acid and a surface active agent as a dispersant, thereby forming spherical phenolic resin particles having a boric acid core. The particles are dipped in hot water for 24 hours, taken out of the water, and dried. Thereafter, the particles are carbonized in a non-oxidizing atmosphere. There are obtained particles of the non-uniform dispersion type in which carbonaceous material having moderate conductivity forms a matrix phase and minute particulates of boron oxide having low conductivity are distributed in the matrix densely on a center side and sparsely on a surface side.

The carbonizing step is often carried out in an inert gas atmosphere. An atmosphere of $NH_3$ or $N_2$ gas may also be used if it is desired to form nitride in the particle interior.

A second embodiment of the first form of the present invention is a powder comprising composite particles of the uniform dispersion type in which a minute particulate dispersed phase having a low conductivity is uniformly dispersed in a matrix phase having a moderate conductivity. The same as previously described in conjunction with the composite particles of the non-uniform dispersion type applies to the second embodiment with respect to the conductivity and material of the matrix phase and minute particulates, the mean particle size of composite particles, and the conductivity and water content of powder. In the case of the uniform dispersion type composite particles, when the matrix phase is of a carbonaceous material, it is possible to use another carbonaceous material having a lower conductivity to form the minute particulates.

Preferably, the minute particulates have a size of from about 1 nm to about 10 μm, more preferably from to about 5 μm. The total amount of minute particulates dispersed ranges from 0.1 to 70% by weight, preferably from 1 to 60% by weight based on the weight of each composite particle. Less than 0.1% of minute particulates would fail to provide the composite particles with a controllable conductivity, but with a conductivity approximately equal to the moderate conductivity of the matrix phase. Composite particles containing more than 70% of minute particulates would probably have electrical properties similar to those of the low conductivity minute particulates.

The composite particles of uniform dispersion type may be prepared by any desired methods, for example, by mixing a starting compound corresponding to the matrix phase having a moderate conductivity (to be referred to as matrix-forming compound) with another starting compound corresponding to the minute particulates having a low conductivity (to be referred to as particulate-forming compound), and granulating the mixture by spray drying or the like; solidifying the mixture through curing reaction or the like and granulating in a ball mill or the like; further heat treating similarly granulated particles at elevated temperatures; and heat treating the mixture prior to granulation. The desired powder may be prepared by a proper choice of the combination of starting compounds and the process including a mixing method, granulating method, and heat treatment (including heat treating means and atmosphere). Depending on the form, thermal and other physical properties of the starting compounds, special procedures (F) to (H) may be employed although the invention is not limited thereto.

(F) The minute particulates are included in the matrix-forming compound directly if it is initially available in liquid or solution form or after it is liquefied, and the liquid material is geled or hardened by a suitable technique and then heat treated. The minute particulates should be solid during the process.

(G) If both the matrix- and minute particulate-forming compounds are initially available in liquid or solution form, composite particles are prepared by mixing them. The minute particulate-forming compound should be a material capable of geling or precipitating faster than the matrix-forming compound. The two compounds are mixed in a selected ratio, geled or hardened, granulated and then heat treated.

(H) If both the matrix- and minute particulate-forming compounds are initially available in solid form, the matrix-forming compound should have fluidity during the powder preparing process and the minute particulate-forming compound should remain solid throughout the process. The two compounds are mixed and optionally heat treated before the mixture is granulated.

The powder of the invention can be prepared by procedures (F) to (H). For a particular combination of starting compounds, it is desired to further heat treat the resulting powder at elevated temperatures because the conductivity of the powder can be changed by controlling the heat treating temperature and atmosphere. For the control of the heat treating atmosphere, for example, an inert gas atmosphere is most often used when it is desired to retain more carbide in the composite particles after heat treatment. An atmosphere of $NH_3$ or $N_2$ gas may be selected particularly when it is desired to generate nitride in the interior of composite particles.

The matrix-forming compound may be selected from organic compounds having a high carbon retention, for example, phenol resins, furan resins, polydimethylsilane resins, and mixtures thereof. The particulate-forming compound may be selected from metal alkoxides (e.g., ethyl silicate, aluminum isopropoxide, and titanium isopropoxide), organometallic complexes (e.g., ferrocene), esters of organic compounds with inorganic acids (e.g., a borate ester synthesized from diethanol amine and boric acid), and insulating and semiconductor materials such as silica, alumina and titania, and mixtures thereof. It is to be noted that the powder of the invention can also be prepared from a combination of an organic compound having a high carbon retention with an organic compound having a higher conductivity after carbonization such as tar and pitch, because there are formed composite particles in which the former compound forms minute particulates and the latter compound forms the matrix phase.

Second Form of Powder

In a second form of the invention, the powder is comprised of composite particles each having a microscopic composite structure or sea-island structure in which minute particulates having a relatively moderate electrical conductivity are dispersed in a matrix phase having a relatively low electrical conductivity.

The distribution of minute particulates in the matrix phase may be either uniform or non-uniform. More particularly, the composite particles may be either composite particles of the uniform dispersion type in which minute particulates are uniformly dispersed in a matrix phase, or composite particles of non-uniform dispersion type in which minute particulates are non-uniformly dispersed in a matrix phase such that the minute particulates are dense near the surface and sparse near the center of the particle, or inversely, the minute particulates are sparse near the surface and dense near the center of the particle.

The second form of powder is obtained by using the matrix-forming material in the first form of powder as a particulate phase and the particulate-forming material in the first form of powder as a matrix phase, and dispersing the former in the latter. Therefore, in the second form of powder, the matrix phase has a low electrical conductivity of preferably up to $10^{-2}$ $Scm^{-1}$, more preferably up to $10^{-6}$ $Scm^{-1}$. In turn, the minute particulates dispersed in the matrix phase should have a higher conductivity than that of the matrix phase. Namely, the conductivity of the dispersed phase is at least 10 times that of the matrix phase, preferably from 10 to $10^{14}$ times, especially from $10^3$ to $10^{14}$ times that of the matrix phase. At the same time as meeting this requirement, the minute particulates or dispersed phase should have a moderate conductivity of $10^{-10}$ to $10^2$ $Scm^{-1}$, preferably $10^{-10}$ to $10^0$ $Scm^{-1}$.

Preferably, the minute particulates have a size of from about 1 nm to about 1 μm, more preferably from about 2 nm to about 0.5 μm. The total amount of minute particulates dispersed ranges from 15 to 99.5% by weight, preferably from 30 to 90% by weight based on the weight of each composite particle. Less than 15% of minute particulates would fail to provide the composite particles with a controllable conductivity, but with a conductivity approximately equal to the low conductivity of the matrix phase. Composite particles containing more than 99.5% of minute particulates would have electrical properties similar to those of the moderate conductivity minute particulates. Where the minute particulates are non-uniformly dispersed in the matrix phase, the quantities of minute particulates dispersed on the surface and center sides may be the same as in the non-uniform dispersion type of the first form.

Also, the mean particle size of composite particles, conductivity and water content of powder are the same as in the first form.

The composite particles in the second form may be prepared by any desired methods, for example, by mixing a starting compound corresponding to the matrix phase having a low conductivity (to be referred to as matrix-forming compound) with another starting compound corresponding to the minute particulates having a moderate conductivity (to be referred to as particulate-forming compound), and granulating the mixture by spray drying or the like; solidifying the mixture through curing reaction or the like and granulating in a ball mill or the like; further heat treating similarly granulated particles at elevated temperatures; and heat treating the mixture prior to granulation. The desired powder may be prepared by a proper choice of the combination of starting compounds and the process including a mixing method, granulating method, and heat treatment (including heat treating means and atmosphere). Depending on the form, thermal and other physical properties of the starting compounds, special procedures (I) to (K) may be employed although the invention is not limited thereto.

(I) The minute particulates are included in the matrix-forming compound directly if it is initially available in liquid or solution form or after it is liquefied, and the liquid material is geled or hardened by a suitable technique and then heat treated. The minute particulates should be solid during the process.

(J) If both the matrix- and minute particulate-forming compounds are initially available in liquid or solution form, composite particles are prepared by mixing them. The minute particulate-forming compound should be a material capable of ge ling or precipitating faster than the matrix-forming compound. The two compounds are mixed in a selected ratio, geled or hardened, granulated and then heat treated.

(K) If both the matrix- and minute particulate-forming compounds are initially available in solid form, the matrix-forming compound should have fluidity during the powder preparing process and the minute particulate-forming compound should remain solid throughout the process. The two compounds are mixed and optionally heat treated before the mixture is granulated.

The powder of the invention can be prepared by procedures (I) to (K). For a particular combination of starting compounds, it is desired to further heat treat the resulting powder at elevated temperatures because the conductivity of the powder can be changed by controlling the heat treating temperature and atmosphere. For the control of the heat treating atmosphere, for example, an inert gas atmosphere is most often used when it is desired to retain more carbide in the composite particles after heat treatment. An atmosphere of $NH_3$ or $N_2$ gas may be selected particularly when it is desired to generate nitride in the interior of composite particles.

The matrix-forming compound may be at least one liquid or soluble compound selected from metal alkoxides (e.g., ethyl silicate, aluminum isopropoxide, and titanium isopropoxide), organometallic complexes (e.g., ferrocene), and esters of organic compounds with inorganic acids (e.g., a borate ester synthesized from diethanol amine and boric acid). The particulate-forming compound may be selected from organic compounds having a high carbon retention, for example, phenol resins, furan resins, polydimethylsilane resins, and mixtures thereof. It is to be noted that the powder of the invention can also be prepared from a combination of an organic compound having a high carbon retention with a compound having a higher conductivity, for example, carbides such as boron carbide and aluminum carbide, organic semiconductor materials such as polyaniline and poly(acene-quinone), and organic compounds such as tar and pitch, because there are formed composite particles in which the former compound forms the matrix phase and the latter compound forms the minute particulates.

Fluid

Contemplated herein is an electrorheological fluid system in which a powder as defined above is dispersed in an oily medium having electrical insulating property.

The dispersion medium may be selected from electrically insulating fluids, for example, hydrocarbon fluids, ester fluids, aromatic fluids, silicone fluids, fluorosilicone fluids, and phosphazene fluids. These fluids may be used singly or as a mixture of two or more. Silicone fluids such as polydimethylsiloxane and polymethylphenylsiloxane are advantageous because they can be used in direct contact with materials having rubbery elasticity. It is to be noted that the insulating fluid which can be used herein is not limited to the illustrated examples.

The insulating fluids preferably have a viscosity of 0.65 to 1000 centistokes (cSt) at 25° C., more preferably 1 to 500 cSt at 25° C. With the use of an insulating fluid having a viscosity in this range as the dispersion medium, the dispersoid can be efficiently dispersed and suspended therein. If the dispersion medium has a too low viscosity, it contains more volatile components and is less stable. If the dispersion medium has a too high viscosity, it means that the initial viscosity in the absence of electrical potential is too high, leading to restricted electrical control of the fluid system.

The electrorheological fluid of the invention is preferably composed of 1 to 60%, more preferably 5 to 55% by weight of the powder or dispersoid and 40 to 99%, more preferably 50 to 95% by weight of the dispersion medium. Less than 1% by weight of the dispersoid provides less electrorheological effect whereas more than 60% by weight of the dispersoid provides the fluid with an increased initial viscosity in the absence of electrical potential.

The electrorheological fluid of the invention may further contain any other dispersoids and additives such as surface active agents, dispersants, and inorganic salts insofar as the benefits of the invention are not materially sacrificed.

There has been described a powder which is resistant against oxidation, thermally stable in the ambient atmosphere, and easy to control its electrical resistance and dielectric constant. Therefore, the powder is an effective dispersoid for an electrorheological fluid and is also useful as an agent for imparting certain electrical properties to polymers.

The electrorheological fluid of the invention has many advantages including (i) a high level of electrorheological effect over a wide temperature range, (ii) stable maintenance of electrorheological properties over a long period of time, (iii) a reduced quantity of electric current through the fluid and reduced power consumption with an electrical potential applied, (iv) possible application of electrical potential in DC or AC form, and (v) easy industrial manufacture and commercial feasibility.

The electrorheological fluid of the invention thus finds applications for the electrical control of mechanical apparatus such as engine mounts, shock absorbers, valves, and clutches.

EXAMPLE

Examples of the present invention are given below by way of illustration and not by way of limitation. All percents are by weight unless otherwise stated.

In the examples, the properties of powders and electrorheological fluids were measured by the following procedures.

Powder's Properties

The size of composite particles was measured by Microtrac SPA/MK-II by Nikkiso Co., Ltd.

Carbon content was measured by a carbon analyzer by Horiba Ltd.

Electrical conductivity was measured on a powder compact by the double terminal method.

The size of dispersed minute particulates was measured under a ultrahigh resolution electronic microscope.

The weight percent of minute particulates in composite particles was measured by the induction coupling plasma (ICP) method after extracting the minute particulates (e.g., silica) with fluoric acid.

The weight percent of minute particulates in different layers in composite particles was measured from a photomicrograph.

Exothermal peak temperature was measured by using TGD 7000 by Shinku Riko Co., Ltd. to effect differential thermal analysis in air at a heating rate of 5° C./min.

Weight loss at 400° C. was measured by using TGD 7000 by Shinku Riko Co., Ltd. to effect thermogravimetric analysis in air at a heating rate of 5° C./min.

Electrorheolocical Fluid's Properties measured by RDS-II by Rheometrics Far East Ltd. at a shearing rate of 350/sec.

EXAMPLE 1

Spheres of a thermosetting phenol resin (Univex S by Unitika Co., Ltd.), 150 grams, were immersed in 160 grams of ortho-silicate ester (Ethyl Silicate 28 by Colcoat Co., Ltd.) for one day and removed by filtration. The impregnated phenolic spheres were washed with ethanol, heated at 40° C. for 8 hours in 400 grams of distilled water having 4 grams of toluenesulfonic acid added thereto, and then removed by filtration. Thereafter, the spheres were dried for 8 hours in a vacuum oven at 80° C. The silicate-laden phenolic spheres were heated to 600° C. in an argon atmosphere at a heating rate of 5° C./min. and heated at the temperature for 1 hour for carbonization, obtaining spherical composite particles having a mean particle size of 37 μm and a specific gravity of 1.45.

These composite particles were composed of a carbonaceous material (carbon content 90.6%) as the matrix phase and silica dispersed as the minute particulates. The carbonaceous material and silica had a conductivity of $6\times10^{-9}$ $Scm^{-1}$ and $1\times10^{-13}$ $Scm^{-1}$, respectively. The powder as a whole had a conductivity of $4\times10^{-12}$ $Scm^{-1}$. The dispersed silica particulates had a size of 20 nm. The overall weight proportion of silica in the composite particles was 5.0% while the weight proportions of silica in a surface-adjoining layer, an intermediate layer, and a center-adjoining layer of the composite particle were 8.7%, 2.5%, and 0%, respectively. After being allowed to stand at room temperature, the powder was measured to have a water content of 0.2%. The powder was also measured for exothermic peak temperature as an index representative of oxidation resistance. The results are shown in Table 1, indicating that the powder had improved oxidation resistance.

As is evident from these data, the powder-forming composite particles obtained in this example had the minute particulate non-uniform dispersion structure that silica particulates were non-uniformly dispersed in a carbonaceous material in a desirable graded distribution pattern that the proportion of silica gradually decreased from the particle surface toward the center. The powder had a high level of heat resistance.

EXAMPLE 2

Example 1 was repeated except that spheres of a different thermosetting phenol resin (Univex C-10 by Unitika Co., Ltd.) and a polysilicate ester (Ethyl Silicate 40 by Colcoat Co., Ltd.) were used and the impregnated phenolic spheres were heated at 80° C. for 2 hours in distilled water having toluenesulfonic acid added thereto. There were obtained spherical composite particles having a mean particle size of 5 μm and a specific gravity of 1.46.

These composite particles were composed of a carbonaceous material (carbon content 91.4%) as the matrix phase and silica as the minute particulates. The composite particles had an overall weight proportion of silica of 2.0% and, as in Example 1, the minute particulate non-uniform dispersion structure that silica particulates were non-uniformly dispersed in the carbonaceous material in a graded distribution pattern so that the silica was dense near the surface and sparse near the center. The powder as a whole had a conductivity of $5\times10^{-12}$ $Scm^{-1}$. After being allowed to stand at room temperature, the powder was measured to have a water content of 0.15%. The oxidation resistance of the powder as represented by exothermic peak temperature is shown in Table 1, indicating that the powder had improved oxidation resistance like that of Example 1.

COMPARATIVE EXAMPLE 1

The phenolic spheres used in Example 2 as such were heated to 600° C. in an argon atmosphere at a heating rate of 5° C./min. and heated at the temperature for 1 hour for carbonization, obtaining spherical particles of carbonaceous material having a mean particle size of 5 μm and a conductivity of $6\times10^{-9}$ $Scm^{-1}$.

The exothermic peak temperature of this powder is also shown in Table 1. It is evident that the powders of Examples 1 and 2 are improved in oxidation resistance over the powder of Comparative Example 1.

TABLE 1

| Powder | Exothermic peak temperature, °C. |
|---|---|
| Example 1 | 560 |
| Example 2 | 560 |
| Comparative Example 1 | 480 |

EXAMPLE 3

The powder of Example 1 was heat treated at 400° C. for 3 hours in air. The heat treatment was effective for partially removing carbon from the powder, resulting in a powder having an increased silica content of 18% and a specific gravity of 1.50. The mean particle size was 34 μm.

EXAMPLE 4

Spheres of a thermosetting phenol resin (Univex UA-30 by Unitika Co., Ltd.), 500 grams, were immersed in 800 ml of acetone for 6 hours. After excess acetone was decanted off, 500 ml of the ortho-silicate ester used in Example 1 was added to the swollen phenolic spheres and stirred for 18 hours. The thus treated phenolic spheres were washed with ethanol, mixed with 1500 ml of distilled water having 25 grams of toluenesulfonic acid added thereto, and stirred for 10 minutes. The mixture was heated at 40° C. for one hour and then at 90° C. for a further one hour. The spheres were removed by filtration, washed, and then dried for 4 hours in a vacuum oven at 80° C.

The silicate-laden phenolic spheres were heated to 620° C. in an argon atmosphere at a heating rate of 2° C./min. and heated at the temperature for 1 hour for carbonization, obtaining spherical composite particles having a mean particle size of 17.3 μm and a specific gravity of 1.46. The composite particles had a silica content of 6.0%.

EXAMPLE 5

Aluminum isopropoxide powder, 100 grams, was mixed with 400 grams of acetone, stirred for 4 hours, and then passed through a pleated paper filter to collect a filtrate. In the filtrate were immersed 250 grams of thermosetting phenol resin spheres (Univex UA-30 by Unitika Co., Ltd.). The impregnated phenolic spheres were successively washed with isopropanol, acetone, and then ethanol, mixed with 500 ml of distilled water having 12.5 grams of toluenesulfonic acid added thereto, and stirred for 10 minutes. The mixture was heated at 40° C. for one hour and then at 90° C. for a further one hour. The spheres were removed by filtration, washed, and then dried for 4 hours in a vacuum oven at 80° C.

The aluminum hydroxide-laden phenolic spheres were heated to 615° C. in an argon atmosphere at a heating rate of 5° C./min. and heated at the temperature for 1 hour for carbonization, obtaining spherical composite particles having a mean particle size of 17.2 μm and a specific gravity of 1.46. The composite particles had an alumina content of 2.0%.

EXAMPLE 6

An electrorheological fluid was prepared by dispersing 50 grams of the powder obtained in Example 1 in 95 grams of silicone fluid (TSF 451-10 by Toshiba Silicone Co., Ltd.). The properties of the electrorheological fluid are shown in Table 2.

The electrorheological fluid had a viscosity of 0.4 poise as measured at room temperature in the absence of electrical potential. Application of a DC electrical potential of 2 kV/mm caused the viscosity to increase to 5.5 poise and a current flow of 0.03 $\mu A/cm^2$. The same fluid had an initial viscosity of 0.2 poise as measured at 100° C. in the absence of electrical potential. With a DC electrical potential of 2 kV/mm applied, the viscosity increased to 7.0 poise and the current value was 1.15 $\mu A/cm^2$.

Table 3 shows changes with time of the viscosity of and electrical current through the fluid at room temperature with a DC potential of 2 kV/mm applied. The fluid maintained its performance unchanged over 1000 hours of use.

As seen from these results, the electrorheological fluid of this example has several benefits including a high electrorheological effect over a wide temperature range, minimal current flow and attendant reduced power consumption with an electrical potential applied, and improved long-term stability.

EXAMPLE 7

An electrorheological fluid was prepared as in Example 6 using the powder obtained in Example 2. The properties of the electrorheological fluid are shown in Table 2.

The electrorheological fluid had a viscosity of 0.6 electrical potential. Application of a DC electrical potential of 2 kV/mm caused the viscosity to increase to 2.4 poise and a current flow of 0.001 $\mu A/cm^2$. The same fluid had an initial viscosity of 0.2 poise as measured at 100° C. in the absence of electrical potential. With a DC electrical potential of 2 kV/mm applied, the viscosity increased to 2.5 poise and the current value was 0.037 $\mu A/cm^2$.

As seen from these results, the electrorheological fluid of this example has improved properties like that of Example 6.

COMPARATIVE EXAMPLE 2

The powder of Comparative Example 1 was dispersed in the same silicone fluid as used in Example 6. There was obtained a suspension fluid whose electrorheological properties are shown in Table 2.

This suspension fluid did not show electrorheological effect and an increased quantity of electrical current flowed upon application of a DC potential. No effective electrorheological fluid was obtained by using only the matrix phase which is identical with that of the composite particles of the invention (carbonaceous material in this example). No satisfactory electrorheological fluid was obtained by using only silica which is typical of the dispersed minute particulates in the composite particles of the invention.

COMPARATIVE EXAMPLE 3

An electrorheological fluid was prepared by dispersing 13 parts by weight of silica gel (Nipsil VN-3 by Nippon Silica Co., Ltd.) having an adjusted water content of 6% by weight in 87 parts by weight of silicone fluid. The properties of the electrorheological fluid are shown in Table 2.

The electrorheological fluid had a viscosity of 3.4 poise as measured at room temperature in the absence of electrical potential. Application of a DC electrical potential of 2 kV/mm caused the viscosity to increase to 6.0 poise and a current flow of 21 $\mu A/cm^2$. At 100° C., the current flow became too high to measure electrorheological effect. This fluid gradually lost its effect during continuous long-term use, approaching less than one-half of the initial effect after about 100 hours.

TABLE 2

| Electro-rheological fluid | Powder | Viscosity (poise) | | | | Current ($\mu A/cm^2$) | |
|---|---|---|---|---|---|---|---|
| | | Nr | Pr | N100 | P100 | Ar | A100 |
| E6 | E1 | 0.4 | 5.5 | 0.2 | 7.0 | 0.03 | 1.15 |
| E7 | E2 | 0.6 | 2.4 | 0.2 | 2.5 | ≦0.001 | 0.037 |
| CE2 | CE1 | 0.4 | UM | 0.2 | UM | high (UM) | high (UM) |
| CE3 | silica gel | 3.4 | 6.0 | 0.8 | UM | 21 | high (UM) |

Nr: viscosity at room temperature without electrical potential

N100: viscosity at 100° C. without electrical potential

Pr: viscosity at room temperature with electrical potential of 2 kV/mm applied

P100: viscosity at 100° C. with electrical potential of 2 kV/mm applied

Ar: current flow at room temperature with electrical potential of 2 kV/mm applied A100: current flow at 100° C. with electrical potential of 2 kV/mm applied UM: unmeasurable

TABLE 3

| | (Example 6) Lapse of time (hour) | | | |
|---|---|---|---|---|
| | 0 | 200 | 500 | 1000 |
| Viscosity* (poise) | 5.5 | 5.4 | 5.5 | 5.6 |
| Current* ($\mu A/cm^2$) | 0.03 | 0.02 | 0.03 | 0.03 |

*at room temperature with DC 2 kV/mm applied Sumitomo Durez Co., Ltd.) and 30 grams of 65% toluene-sulfonic acid in water. The mixture was spray dried. The powder was carbonized as in Example 11, obtaining spherical composite particles having a mean particle size of 15 μm and a specific gravity of 2.6.

EXAMPLE 8

An electrorheological fluid was prepared as in Example 6 using the powder obtained in Example 3.

The fluid had a viscosity of 0.5 poise as measured at room temperature in the absence of electrical potential. Application of a DC electrical potential of 2 kV/mm caused the viscosity to increase to 4.8 poise and a current flow of 0.001 $\mu A/cm^2$. The same fluid had an initial viscosity of 0.2 poise as measured at 80° C. in the absence of electrical potential. With a DC electrical potential of 2 kV/mm applied, the viscosity increased to 5.6 poise and the current value was 0.011 $\mu A/cm^2$.

As seen from these results, the powder of Example 3 had improved properties.

EXAMPLE 9

An electrorheological fluid was prepared as in Example 6 using the powder obtained in Example 4. The fluid had a viscosity of 0.5 poise as measured at room temperature in the absence of electrical potential. Application of a DC electrical potential of 2 kV/mm caused the viscosity to increase to 13 poise and a current flow of up to 2 $\mu A/cm^2$.

As seen from these results, the powder of Example 4 had improved properties.

EXAMPLE 10

An electrorheological fluid was prepared as in Example 6 using the powder obtained in Example 5. The fluid had a viscosity of 0.5 poise as measured at room temperature in the absence of electrical potential. Application of a DC electrical potential of 2 kV/mm caused the viscosity to increase to 9 poise and a current flow of 1.2 $\mu A/cm^2$.

As seen from these results, the powder of Example 5 had improved properties.

EXAMPLE 11

A mixture of 60 grams of resol type phenol resin (available from Sumitomo Durez Co., Ltd.), 30 grams of polysilicate ester (Ethyl Silicate 40 by Colcoat Co., Ltd.), and 10 grams of toluenesulfonic acid was vigorously agitated. When gelation started, the mixture was finely mashed into powder by means of a mortar. The powder was heated to 625° C. in an argon atmosphere at a heating rate of 5° C./min. and heated at the temperature for 1 hour for carbonization, obtaining spherical composite particles having a mean particle size of 10 $\mu m$ and a specific gravity of 2.1.

These composite particles were composed of a carbonaceous material as the matrix phase and silica as the minute particulates. The carbonaceous material and silica had a conductivity of $4\times10^{-9}$ $Scm^{-1}$ and $1\times10^{-14}$ $Scm^{-1}$, respectively. The powder as a whole had a conductivity of $3\times10^{-12}$ $Scm^{-1}$. The dispersed silica particulates had a size of 60 nm. The overall weight proportion of silica in the composite particles was 29%. After being allowed to stand at room temperature, the powder was measured to have a water content of 0.2%. The powder was also measured for exothermic peak temperature as an index representative of oxidation resistance. The results are shown in Table 4, indicating that the powder had improved oxidation resistance.

As is evident from these data, the powder-forming composite particles obtained in this example had the minute particulate uniform dispersion structure that silica particulates were uniformly dispersed in a carbonaceous material. The powder had a high level of heat resistance.

EXAMPLE 12

In 400 grams of water was dispersed 50 grams of aluminum hydroxide powder. To this dispersion were added 100 grams of water-soluble phenol resin (available from Sumitomo Durez Co., Ltd.) and 30 grams of 65% toluene. sulfonic acid in water. The mixture was spray dried. The powder was carbonized as in Example 11, obtaining spherical composite particles having a mean particle size of 15 $\mu m$ and a specific gravity of 2.6.

These composite particles were composed of a carbonaceous material as the matrix phase and alumina as the minute particulates. The carbonaceous material and alumina had a conductivity of $4\times10^{-9}$ $Scm^{-1}$ and up to $1\times10^{-14}$ $Scm^{-1}$, respectively. The powder as a whole had a conductivity of $8\times10^{-12}$ $Scm^{-1}$. The dispersed alumina particulates had a size of 0.8 $\mu m$. The overall weight proportion of silica in the composite particles was 47% while the composite particles had the minute particulate uniform dispersion structure as in Example 11. After being allowed to stand at room temperature, the powder was measured to have a water content of 0.25%. As shown in Table 4, the powder had improved oxidation resistance like that of Example 11.

COMPARATIVE EXAMPLE 4

A mixed aqueous solution containing 30% of the water-soluble phenol resin used in Example 12 and 1% of toluene-sulfonic acid was spray dried. The powder was heated to 625° C. in an argon atmosphere at a heating rate of 5° C./min. and heated at the temperature for 1 hour for carbonization, obtaining particles of carbonaceous material having a mean particle size of 12 $\mu m$ and a conductivity of $6\times10^{-9}$ $Scm^{-1}$.

The powders of Examples 11, 12 and Comparative Example 4 were measured for weight loss at 400° C. in air with the results shown in Table 4. The powders of Examples 11 and 12 had superior oxidation resistance to that of Comparative Example 4.

TABLE 4

| Powder | Weight loss at 400° C. in air (%) |
|---|---|
| Example 11 | 1.0 |
| Example 12 | 2.0 |
| Comparative Example 4 | 8.0 |

EXAMPLE 13

An electrorheological fluid was prepared by dispersing 50 grams of the powder obtained in Example 11 in 95 grams of silicone fluid (TSF 451-10 by Toshiba Silicone Co., Ltd.). The properties of the electrorheological fluid are shown in Table 5.

The electrorheological fluid had a viscosity of 0.4 poise as measured at room temperature in the absence of electrical potential. Application of a DC electrical potential of 2 kV/mm caused the viscosity to increase to 2.5 poise and a current flow of 0.001 $\mu A/cm^2$. The same fluid had an initial viscosity of 0.2 poise as measured at 100° C. in the absence of electrical potential. With a DC electrical potential of 2 kV/mm applied, the viscosity increased to 3.0 poise and the current value was 0.1 $\mu A/cm^2$.

Table 6 shows changes with time of the viscosity of and electrical current through the fluid at room temperature with a DC potential of 2 kV/mm applied. The fluid maintained its performance unchanged over 1000 hours of use.

As seen from these results, the electrorheological fluid of this example has several benefits including a high electrorheological effect over a wide temperature range, minimal current flow and attendant reduced power consumption with an electrical potential applied, and improved long-term stability.

EXAMPLE 14

An electrorheological fluid was prepared as in Example 13 using the powder obtained in Example 12. The properties of the electrorheological fluid are shown in Table 5.

The electrorheological fluid had a viscosity of 0.8 poise as measured at room temperature in the absence of electrical potential. Application of a DC electrical potential of 2 kV/mm caused the viscosity to increase to 8.13 poise and a current flow of 12 $\mu A/cm^2$. The same fluid had an initial viscosity of 0.3 poise as measured at 100° C. in the absence of electrical potential. With a DC electrical potential of 2 kV/mm applied, the viscosity increased to 7.9 poise and the current value was 96 $\mu A/cm^2$.

As seen from these results, the electrorheological fluid of this example has improved properties like that of Example 13.

COMPARATIVE EXAMPLE 5

The powder of Comparative Example 4 was dispersed in the same silicone fluid as used in Example 13. There was obtained a suspension fluid whose electrorheological properties are shown in Table 5.

This suspension fluid did not show electrorheological effect and an increased quantity of electrical current flowed upon application of a DC potential. No effective electrorheological fluid was obtained by using only the matrix phase which is identical with that of the composite particles of the invention (carbonaceous material in this example). No satisfactory electrorheological fluid was obtained by using only silica or alumina which is typical of the dispersed minute particulates in the composite particles of the invention.

TABLE 5

| Electro-rheological fluid | Powder | Viscosity (poise) Nr | Pr | N100 | P100 | Current ($\mu A/cm^2$) Ar | A100 |
|---|---|---|---|---|---|---|---|
| E13 | E11 | 0.4 | 2.5 | 0.2 | 3.0 | ≦0.001 | 0.1 |
| E14 | E12 | 0.8 | 8.13 | 0.3 | 7.9 | 12 | 96 |
| CE5 | CE4 | 0.4 | 0.4 | 0.2 | 0.2 | 12 | 96 |
| CE3 | silica gel | 3.4 | 6.0 | 0.8 | UM | 21 | too large (UM) |

Nr, Pr, N100, P100, Ar, A100, UM are as defined for Table 2.

TABLE 6

| | (Example 13) Lapse of time (hour) 0 | 200 | 500 | 1000 |
|---|---|---|---|---|
| Viscosity* (poise) | 2.5 | 2.4 | 2.6 | 2.5 |
| Current* ($\mu A/cm^2$) | ≦0.001 | ≦0.001 | ≦0.001 | ≦0.001 |

*at room temperature with DC 2 kV/mm applied

EXAMPLE 15

A mixture of 30 grams of resol type phenol resin (available from Sumitomo Durez Co., Ltd.), 200 grams of polysilicate ester (Ethyl Silicate 40 by Colcoat Co., Ltd.), and 6 grams of toluenesulfonic acid was vigorously agitated. When gelation started, the mixture was finely mashed into powder by means of a mortar. The powder was heated to 900° C. in an argon atmosphere at a heating rate of 5° C./min. and heated at the temperature for 1 hour for carbonization, obtaining spherical composite particles having a mean particle size of 10 μm and a specific gravity of 2.6.

These composite particles were composed of silica as the matrix phase and a carbonaceous material as the minute particulates. The silica and carbonaceous material had a conductivity of $1\times10^{-14}$ $Scm^{-1}$ and $2\times10^{-9}$ $Scm^{-1}$, respectively. The powder as a whole had a conductivity of $3\times10^{-12}$ $Scm^{-1}$. The dispersed carbonaceous material particulates had a size of 100 nm. The amount of carbonaceous material dispersed in the composite particles was 18%. After being allowed to stand at room temperature, the powder was measured to have a water content of 0.2%. The powder was also measured for weight loss at 400° C. in air as an index representative of oxidation resistance, finding a weight loss of 0.5%. The powder of this example had improved oxidation resistance as seen from a comparison with the weight loss of Comparative Example 6.

As is evident from these data, the powder-forming composite particles obtained in this example had the minute particulate uniform dispersion structure that carbonaceous material particulates were uniformly dispersed in silica. The powder had a high level of heat resistance.

EXAMPLE 16

In 200 grams of 5% sodium silicate in water was dispersed 20 grams of carbon powder. The dispersion was spray dried. The powder was vacuum dried at 120° C., obtaining spherical composite particles having a mean particle size of 12 μm and a specific gravity of 1.5.

These composite particles were composed of sodium silicate as the matrix phase and a carbonaceous material as the minute particulates. The sodium silicate and carbonaceous material had a conductivity of $1\times10^{-14}$ $Scm^{-1}$ and up to $1\times10^{-6}$ $Scm^{-1}$, respectively. The powder as a whole had a conductivity of $3\times10^{-9}$ $Scm^{-1}$. The dispersed carbonaceous material particulates had a size of 2.5 μm. The amount of carbonaceous material dispersed in the composite particles was 95% and the composite particles had the minute particulate uniform dispersion structure as in Example 15. After being allowed to stand at room temperature, the powder was measured to have a water content of 0.2%. The powder had improved oxidation resistance like that of Example 15.

EXAMPLE 17

In 150 grams of water was dispersed 50 grams of carbon powder. 2.5 grams of an acrylic resin emulsion (resin content 40%) was diluted with 50 grams of water. The dispersion was combined with the dilution to form a mixture which was spray dried. The powder was vacuum dried at 80° C., obtaining spherical composite particles having a mean particle size of 15 μm and a specific gravity of 1.5.

These composite particles were composed of acrylic resin as the matrix phase and a carbonaceous material as the minute particulates. The acrylic resin and carbonaceous material had a conductivity of $1\times10^{-14}$ $Scm^{-1}$ and up to $1\times10^{-6}$ $Scm^{-1}$, respectively. The powder as a whole had a conductivity of $4\times10^{-9}$ $Scm^{-1}$. The dispersed carbonaceous material particulates had a size of 2.5 μm. The amount of carbonaceous material dispersed in the composite particles was 94% and the composite particles had the minute particulate uniform dispersion structure as in Example 15. After being allowed to stand at room temperature, the powder was measured to have a water content of 0.2%. The powder had improved oxidation resistance like that of Example 15.

EXAMPLE 18

To 326 grams of a mixture of water and ethanol (40%/60%) were added 21 grams of resol type phenol resin (available from Sumitomo Durez Co., Ltd.), 49 grams of spinning pitch powder (Asahi Kokusu Kougyou Co., Ltd.), and 3.8 grams of toluenesulfonic acid. The mixture was vigorously agitated and then spray dried. The powder was dried at 100° C. for 6 hours, heated to 470° C. in a nitrogen atmosphere at a heating rate of 2° C./min. and heated at the temperature for 1 hour for carbonization, obtaining spherical composite particles having a mean particle size of 30 μm.

The source components constituting the powder were separately carbonized under the same conditions as above and the resulting powders were measured for conductivity. The matrix phase and minute particulates had a conductivity of $3\times10^{-10}$ $Scm^{-1}$ and $7\times10^{-5}$ $Scm^{-1}$, respectively. The powder as a whole had a conductivity of $1\times10^{-9}$ $Scm^{-1}$.

These composite particles were obtained by carbonizing particles composed of a carbonaceous material in the form of phenolic resin, which is a difficultly carbonizable carbon, as the matrix phase and a pitch powder, which is a readily carbonizable carbon, dispersed therein as the minute particulates. When heat treated at the same temperature, the carbonized product of the former had a lower conductivity than the carbonized product of the latter. Namely, the powder of this example was composed of composite particles in which the matrix had a lower conductivity than the minute particulates dispersed therein.

EXAMPLE 19

To 793 grams of a mixture of water and ethanol (40%/60%) were added 70 grams of resol type phenol resin (available from Sumitomo Durez Co., Ltd.), 70 grams of spinning pitch powder (Asahi Kokusu Kougyou Co., Ltd.), and 12.6 grams of toluenesulfonic acid. The mixture was vigorously agitated and then spray dried. The powder was dried at 100° C. for 6 hours, heated to 420° C. in a nitrogen atmosphere at a heating rate of 2° C./min. and heated at the temperature for 1 hour for carbonization, obtaining spherical composite particles having a mean particle size of 10 μm.

The source components constituting the powder were separately carbonized under the same conditions as above and the resulting powders were measured for conductivity. The matrix phase and minute particulates had a conductivity of $3\times10^{-10}$ $Scm^{-1}$ and $7\times10^{-5}$ $Scm^{-1}$, respectively.

COMPARATIVE EXAMPLE 6

100 grams of the resol type phenol resin used in Example 15 and 20 grams of toluenesulfonic acid were stirred in a laboratory mixer and reaction effected while continuing milling. The powder was heated to 900° C. in an argon atmosphere at a heating rate of 5° C./min. and heated at the temperature for 1 hour for carbonization, obtaining spherical particles of carbonaceous material having a mean particle size of 15 μm and a conductivity of $1\times10^{-6}$ $Scm^{-1}$.

The powder was measured for weight loss at 400° C. in air, finding a weight loss of 8%. Evidently, the powder of Example 15 had improved oxidation resistance over that of Comparative Example 6.

EXAMPLE 20

An electrorheological fluid was prepared by dispersing 50 grams of the powder obtained in Example 15 in 95 grams of silicone fluid (TSF 451-10 by Toshiba Silicone Co., Ltd.). The properties of the electrorheological fluid are shown in Table 7.

The electrorheological fluid had a viscosity of 0.6 poise as measured at room temperature in the absence of electrical potential. Application of a DC electrical potential of 2 kV/mm caused the viscosity to increase to 3.0 poise and a current flow of 0.001 $\mu A/cm^2$. The same fluid had an initial viscosity of 0.2 poise as measured at 100° C. in the absence of electrical potential. With a DC electrical potential of 2 kV/mm applied, the viscosity increased to 2.8 poise and the current value was 0.9 $\mu A/cm^2$.

Table 8 shows changes with time of the viscosity of and electrical current through the fluid at room temperature with a DC potential of 2 kV/mm applied. The fluid maintained its performance unchanged over 1000 hours of use.

As seen from these results, the electrorheological fluid of this example has several benefits including a high electrorheological effect over a wide temperature range, minimal current flow and attendant reduced power consumption with an electrical potential applied, and improved long-term stability.

EXAMPLE 21

An electrorheological fluid was prepared as in Example 20 using the powder obtained in Example 16. The properties of the electrorheological fluid are shown in Table 7.

The electrorheological fluid had a viscosity of 0.5 poise as measured at room temperature in the absence of electrical potential. Application of a DC electrical potential of 2 kV/mm caused the viscosity to increase to 5.0 poise and a current flow of 5.6 $\mu A/cm^2$. The same fluid had an initial viscosity of 0.3 poise as measured at 100° C. in the absence of electrical potential. With a DC electrical potential of 2 kV/mm applied, the viscosity increased to 4.8 poise and the current value was 57.3 $\mu A/cm^2$.

As seen from these results, the electrorheological fluid of this example has improved properties like that of Example 20.

EXAMPLE 22

An electrorheological fluid was prepared as in Example 20 using the powder obtained in Example 17. The properties of the electrorheological fluid are shown in Table 7.

The electrorheological fluid had a viscosity of 0.5 poise as measured at room temperature in the absence of electrical potential. Application of a DC electrical potential of 2 kV/mm caused the viscosity to increase to 6.5 poise and a current flow of 6.5 $\mu A/cm^2$. The same fluid had an initial viscosity of 0.3 poise as measured at 100° C. in the absence of electrical potential. With a DC electrical potential of 2 kV/mm applied, the viscosity increased to 6.4 poise and the current value was 69 $\mu A/cm^2$.

As seen from these results, the electrorheological fluid of this example has improved properties like that of Example 20.

COMPARATIVE EXAMPLE 7

The powder of Comparative Example 6 was dispersed in the same silicone fluid as used in Example 20. There was obtained a suspension fluid whose electrorheological properties are shown in Table 7.

This suspension fluid did not show electrorheological effect and an increased quantity of electrical current flowed upon application of a DC potential. No effective electrorheological fluid was obtained by using only the minute particulate material which is identical with that of the composite particles of the invention (carbonaceous material in this example). No satisfactory electrorheological fluid was obtained by using only silica or acrylic resin which is typical of the matrix phase in the composite particles of the invention.

TABLE 7

| Electro-rheological fluid | Powder | Viscosity (poise) | | | | Current ($\mu A/cm^2$ | |
|---|---|---|---|---|---|---|---|
| | | Nr | Pr | N100 | P100 | Ar | A100 |
| E20 | E15 | 0.6 | 3.0 | 0.2 | 2.8 | ≦0.001 | 0.9 |
| E21 | E16 | 0.5 | 5.0 | 0.3 | 4.8 | 5.6 | 57.3 |
| E22 | E17 | 0.5 | 6.5 | 0.3 | 6.4 | 6.5 | 69 |
| CE7 | CE6 | 0.4 | UM | 0.2 | UM | UM | 96 |
| CE3 | silica gel | 3.4 | 6.0 | 0.8 | UM | 21 | too large (UM) |

Nr, Pr, N100, P100, Ar, A100, UM are as defined for Table 2.

TABLE 8

| | (Example 20) Lapse of time (hour) | | | |
|---|---|---|---|---|
| | 0 | 200 | 500 | 1000 |
| Viscosity* (poise) | 3.0 | 2.9 | 3.1 | 3.1 |
| Current* ($\mu A/cm^2$) | ≦0.001 | ≦0.001 | ≦0.001 | ≦0.001 |

*at room temperature with DC 2 kV/mm applied

EXAMPLE 23

An electrorheological fluid was prepared as in Example 20 using the powder obtained in Example 18.

The fluid had a viscosity of 0.6 poise as measured at room temperature in the absence of electrical potential. Application of a DC electrical potential of 2 kV/mm caused the viscosity to increase to 6.7 poise and a current flow of 30.3 $\mu A/cm^2$.

As seen from these results, the powder of Example 18 had improved properties.

EXAMPLE 24

An electrorheological fluid was prepared as in Example 20 using the powder obtained in Example 19. The fluid had a viscosity of 1.26 poise as measured at room temperature in the absence of electrical potential. Application of a DC electrical potential of 2 kV/mm caused the viscosity to increase to 6.1 poise and a current flow of 0.7 $\mu A/cm^2$.

As seen from these results, the powder of Example 19 had improved properties.

Although some preferred embodiments have been described, many modifications and variations may be made thereto in the light of the above teachings. It is therefore to be understood that within the scope of the appended claims, the invention may be practiced otherwise than as specifically described.

We claim:

1. An electrorheological fluid, comprising a powder dispersed in an electrically insulating oily medium, said powder comprising composite particles comprised of a matrix phase having minute particulates uniformly dispersed therein, wherein said matrix phase has an electrical conductivity of $10^{-10}$ to $10^2$ $Scm^{-1}$, said dispersed particulates have an electrical conductivity of up to $10^{-2}$ $Scm^{-1}$ and in the range of 1/10 to $1/10^{14}$ of the electrical conductivity of said matrix phase, and said dispersed particulates are present in an amount of 0.1 to 70% by weight based on the weight of each composite particle.

2. An electrorheological fluid, comprising a powder dispersed in an electrically insulating oily medium, said powder comprising composite particles comprised of a matrix phase having minute particulates non-uniformly dispersed therein such that either (1) more minute particulates are present near the surface than near the center of the composite particle or (2) more minute particulates are present near the center than near the surface of the composite particle; wherein said matrix phase has an electrical conductivity of $10^{-10}$ to $10^2$ $Scm^{-1}$, said dispersed particulates have an electrical conductivity of up to $10^{-2}$ $Scm^{-1}$ and in the range of 1/10 to $1/10^{14}$ of the electrical conductivity of said matrix phase, and said dispersed particulates are present in an amount of 0.01 to 40% by weight based on the weight of each composite particle.

3. An electrorheological fluid, comprising a powder dispersed in an electrically insulating oily medium, said powder comprising composite particles comprised of a matrix phase having minute particulates dispersed therein, wherein said matrix phase has an electrical conductivity of up to $10^{-2}$ $Scm^{-1}$, said dispersed particulates have an electrical conductivity of $10^{-10}$ to $10^2$ $Scm^{-1}$ and in the range of 10 to $10^{14}$ times the electrical conductivity of said matrix phase, and said dispersed particulates are present in an amount of 15 to 99.5% by weight based on the weight of each composite particle.

4. The electrorheological fluid according to claim 1, 2, or 3, wherein said composite particles have a mean particle size of 0.1 to 100 $\mu m$ and the size of said minute particulates is in the range from about 1 nm to about 1 $\mu m$.

5. The electrorheological fluid according to claim 1, 2, or 3, wherein said fluid comprises 1 to 60% by weight of said powder and 99 to 40% by weight of said oily medium.

6. The electrorheological fluid according to claim 1 or 2, wherein said matrix phase is comprised of a material selected from the group consisting of carbonaceous materials, boron carbide, aluminum carbide, polyaniline, poly(acene-quinone), zinc oxide, potassium titanate, and barium titanate.

7. The electrorheological fluid according to claim 1 or 2, wherein said minute particulate is comprised of a material selected from the group consisting of aluminum oxide, silica, boron oxide, titania, calcium oxide, iron oxide, tin oxide, zinc oxide, silicon carbide, silicon nitride, and aluminum nitride.

8. The electrorheological fluid according to claim 3, wherein said matrix phase is comprised of a material selected from the group consisting of metal alkoxides, organometallic complexes, and esters of organic compounds with inorganic acids.

9. The electrorheological fluid according to claim 3, wherein said minute particulate is comprised of a material selected from the group consisting of phenol resins, furan resins, and polydimethylsilane resins.

10. The electrorheological fluid according to claim 1, 2, or 3, wherein said oily medium is selected from the group consisting of hydrocarbon fluids, ester fluids, aromatic fluids, silicone fluids, fluorosilicone fluids, and mixtures thereof.

11. The electrorheological fluid according to claim 10, wherein said oily medium is polydimethylsiloxane, polymethylphenylsiloxane or a mixture thereof.

12. The electrorheological fluid according to claim 1, wherein said minute particulate is comprised of a material selected from the group consisting of metal alkoxides, organometallic complexes, and esters of organic compounds with inorganic acids.

13. The electrorheological fluid according to claim 1, wherein said matrix phase is comprised of a material selected from the group consisting of phenol resins, furan resins, and polydimethylsilane resins.

14. The electrorheological fluid according to claim 3, wherein said matrix phase is comprised of a material selected from the group consisting of aluminum oxide, silica, boron oxide, titania, calcium oxide, iron oxide, tin oxide, zinc oxide, silicon carbide, silicon nitride, and aluminum nitride.

15. The electrorheological fluid according to claim 3, wherein minute particulate is comprised of a material selected from the group consisting of carbonaceous materials, boron carbide, aluminum carbide, polyaniline, poly(acene-quinone), zinc oxide, potassium titanate, and barium titanate.

* * * * *